United States Patent [19]

Hotger

[11] Patent Number: 4,471,998

[45] Date of Patent: Sep. 18, 1984

[54] CUTTER DRUM ASSEMBLY FOR LONGWALL MINING MACHINES

[75] Inventor: Karl Hotger, Bochum, Fed. Rep. of Germany

[73] Assignee: Gebr. Eickhoff Maschinenfabrik und Eisengiesserei m.b.H., Bochum, Fed. Rep. of Germany

[21] Appl. No.: 416,930

[22] Filed: Sep. 13, 1982

[30] Foreign Application Priority Data

Oct. 1, 1981 [DE] Fed. Rep. of Germany ..... 3139012

[51] Int. Cl.[3] ..... E21C 35/20; E21C 35/22

[52] U.S. Cl. ..... 299/81; 137/624.13; 239/225; 239/447

[58] Field of Search ..... 299/81, 12; 137/624.13; 239/66, 97, 225, 447

[56] References Cited

U.S. PATENT DOCUMENTS

| | | | |
|---|---|---|---|
| 1,763,154 | 6/1930 | Holzwarth | 137/624.13 X |
| 3,374,033 | 3/1968 | Arentzen | 299/81 |
| 3,747,982 | 7/1973 | Agnew et al. | 299/81 |
| 4,049,318 | 9/1977 | Fruin | 299/81 |
| 4,368,925 | 1/1983 | Honke | 299/81 X |

*Primary Examiner*—James A. Leppink
*Assistant Examiner*—Beverly E. Hjorth
*Attorney, Agent, or Firm*—Thomas H. Murray; Clifford A. Poff

[57] ABSTRACT

A cutter drum assembly for longwall mining machines incorporating means for spraying trickle water onto the face area being mined as the cutter drum rotates. This requires valving for supplying high-pressure liquid to only those nozzles adjacent the face area as the drum rotates. In accordance with the invention, the valving takes the form of individual valves spaced around the drum, the valves being actuated by a relatively low-pressure control medium (i.e., a liquid) which obviates the necessity for the close tolerances and rigid sealing requirements of prior art devices where high-pressure liquid valve assemblies were built into the rotary connection between a support shaft and the drum which rotates about it.

6 Claims, 4 Drawing Figures

CUTTER DRUM ASSEMBLY FOR LONGWALL MINING MACHINES

BACKGROUND OF THE INVENTION

The present invention relates to a longwall mining machine of the type having a pivot arm which supports a cutter drum for rotation about an axis for working a mine face. In a mining machine of this type, the rotating cutter drum cuts the material being mined and is provided with spiral flights which assist in loading the mined material onto a face conveyor. The cutter drum often carries nozzles on the periphery of its spiral conveying flights for directing trickle of liquid onto the face area being mined. The flow of liquid to the nozzle is controlled by valves spaced around the axis of the drum, these valves being actuated such that liquid is delivered only from those nozzles immediately adjacent the working face.

In U.S. Pat. No. 1,473,498, a cutter drum assembly for mining machines is disclosed wherein the nozzles on the periphery of the cutting drum are connected through conduits and valves to a source of liquid under pressure, the valves being actuated to deliver liquid to the nozzles immediately adjacent the working face by a cam which does not rotate with the cutter drum itself.

Another cutter drum assembly for mining machines is disclosed in U.S. Pat. No. 4,212,497 wherein a valve system is provided for nozzles on the periphery of the cutter drum, the valve taking the form of a recess which communicates with a high pressure passageway extending through the shearer drum shaft and which extends over the shearer drum periphery through an angle corresponding to the activation zone of the nozzles. The recess is disposed in a component which does not cooperate with the shearer drum (e.g., the drum-carrying shaft which does not rotate with the drum) or a non-rotating tube mounted centrally inside the shearer drum drive shaft. The recess in the aforesaid arrangement is covered by means of the cutter drum hub which extends around the drum shaft and is provided with appropriate seals, or by the drum drive shaft which extends in a liquid-tight manner around the tube, both the latter shafts co-rotating with the shearer drum. Radial conduits communicating with the various nozzles or nozzle groups extend into that bore portion of the cutter drum hub or drive shaft which covers the recesses.

In a shearer drum such as that described in U.S. Pat. No. 1,473,498, the various valves are actuated through the agency of a cam, a system which requires delicate linkages to transmit the actuating movement. On the other hand, in a construction such as that shown in U.S. Pat. No. 4,212,497, the operative period of the high-pressure liquid delivered from the nozzles is controlled directly by the cutter drum drive shaft and the stationary tube inside the shaft bore, or by the cutter drum shaft and the cutter drum hub therearound. Because of the high pressure of the liquid forced through the nozzles, the control faces of the drum parts which slide one on the other have to be manufactured to extremely close tolerances if a liquid-tight seal is to be achieved. This extreme precision makes production expensive. Also, a mechanism of this kind experiences heavy wear and impairs rotation of the drum to some extent.

SUMMARY OF THE INVENTION

In accordance with the present invention, the foregoing disadvantages of prior art control arrangements for nozzles on the periphery of a cutter drum are obviated. Specifically, the cutter drum of the invention is provided with valves which are part of a mechanicaly live shaft and bore connection and co-rotate with the shearer drum itself. The valves each comprise pistons having a small diameter end permanently subjected to the pressure of high-pressure liquid to be forced through the nozzles, and a large diameter end which is acted upon by a lower pressure hydraulic fluid at the cadence of shearer drum rotation. Duration of application of the control hydraulic liquid is controlled by means of radial bores or recesses in the periphery of the cutter drum shaft and recesses or radial bores in the bore periphery of the shaft such that only that valve which controls delivery of high-pressure liquid to those nozzles near the mineral face will be in communication with the shaft bore carrying high-pressure liquid at any time.

Since the pressure of the control hydraulic fluid used to actuate the valves is reduced considerably, those surface parts of the shearer drum shaft or of the central bore in the mechanically live shaft and bore connection which serve as control elements can be manufactured to much lower tolerances without impairment of valve operation. As a result, wear in this area likely to impair the function of the control system is reduced considerably. Additionally, rotation of the cutter drum around its shaft is improved due to the lack of precise tolerances between the cutter drum parts which slide one over the other.

Preferably, there are two diametrically-opposite recesses which extend over a sector angle of approximately 150°. These are disposed within the central bore in the periphery of the cutter drum shaft bore or in the periphery of the last-mentioned bore. As the cutter drum rotates, the recesses connect the individual valves consecutively to an axial bore in the shaft carrying hydraulic fluid and to the discharge bore of the cutter drum shaft. Consequently, as the cutter drum rotates, the various valves are supplied with high-pressure liquid in a continuous sequence such that those nozzles of the machine which are remote from the mineral face are isolated from the high-pressure liquid while those adjacent or facing the mineral face are connected to the high-pressure liquid.

In order that the peripheral region of the cutter drum whose nozzles are to be supplied with high-pressure liquid may be brought into registry with the mineral face when the direction of movement of the mining machine is reversed, the cutter drum shaft can be mounted for adjustment around its longitudinal axis and can be secured in any one of a number of positions. Rotation of the cutter drum shaft, for instance, through a semi-circle enables high-pressure liquid to be supplied to those nozzles on the drum periphery which are adjacent the mineral face when the direction of machine movement is reversed The above and other objects and features of the invention will become apparent from the following detailed description taken in connection with the accompanying drawings which form a part of this specification, and in which:

Figure 1:
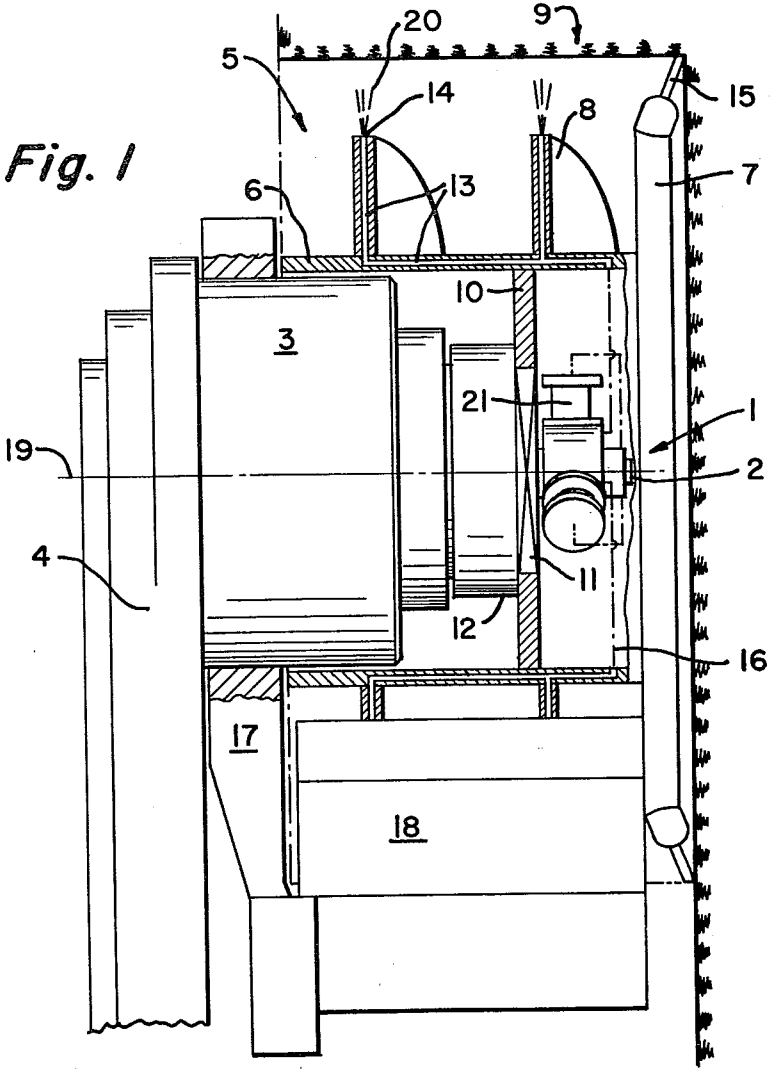
FIG. 1 is an elevational view, partly in section, of a longwall mining machine cutter drum incorporating the system of the invention.

With reference now to the drawings, and particularly to FIG. 1, a cutter drum assembly for a longwall mining machine is shown which incorporates a live shaft and bore connection 1 disposed on a stationary shaft 2 projecting from reduction gearing within a housing 3 of a support arm 4 mounted for vertical pivotal movement on a longwall mining machine, not shown. An electric motor also not shown, is connected through gearing in the support arm 4 to the reduction gearing within housing 3 and thence to the cutter drum itself, generally indicated by the reference numeral 5. The cutter drum 5 includes a cylindrical main casing 6 which extends around the housing 3 and shaft 2. The casing 6 has an outer annular flange or web 7 on its side near the mineral face and is provided around its periphery with one or more helical flights 8 which extend over the whole length of the drum. Cutter picks, not shown, are disposed on the outer periphery of the flights 8 and act to break up that part of the mineral face 9 which is presented to the drum 5 as it rotates, the flights 8 acting to discharge the resulting debris or mined material laterally to a face conveyor, not shown. The casing 6 is provided internally with a flange 10 coupled by way of a square plate 11 to a flange 12 which is rotated by the reduction gearing within the housing 3. Thus, rotation of the gearing within housing 3 acts to cause rotation of the entire cutter drum 5.

The casing 6 and the flights 8 are provided with liquid conduits or bores 13 which are combined in the drum 5 inasmuch as they supply identical segments on the drum periphery with liquid. As shown, the conduits 13 terminate in nozzles 14 which cooperate with cutter tools 15 on flange 7. As will be explained in detail hereinafter, the high-pressure liquid is supplied to the drum 5 through conduits 16 connected to the drive shaft and bore connection 1. Extending around the housing 3 between the drum 5 and arm 4 is a clearing plow holder 17 which is releasably connected to a clearing plow 18 and which can be pivoted by a mechanism, not shown, around the central axis 19 of the drum 5. The plow 18, as is conventional, always covers that part of the drum periphery which is opposite the face 9 and helps to improve the discharge of mined material from the back of the cut.

Streams 20 of high-pressure liquid issuing from the nozzles 14 serve to improve the loosening action of the tools 15 and/or are used for dust control. The discharge of liquid is always restricted to that region of the drum periphery which is near the face region immediately ahead of the cutter drum 5 in the direction of machine movement. Consequently, the mining machine must have a control facility to insure that only those nozzles 14 of the cutter drum 5 which are immediately adjacent the face 9 are supplied with high-pressure liquid.

Figure 2:
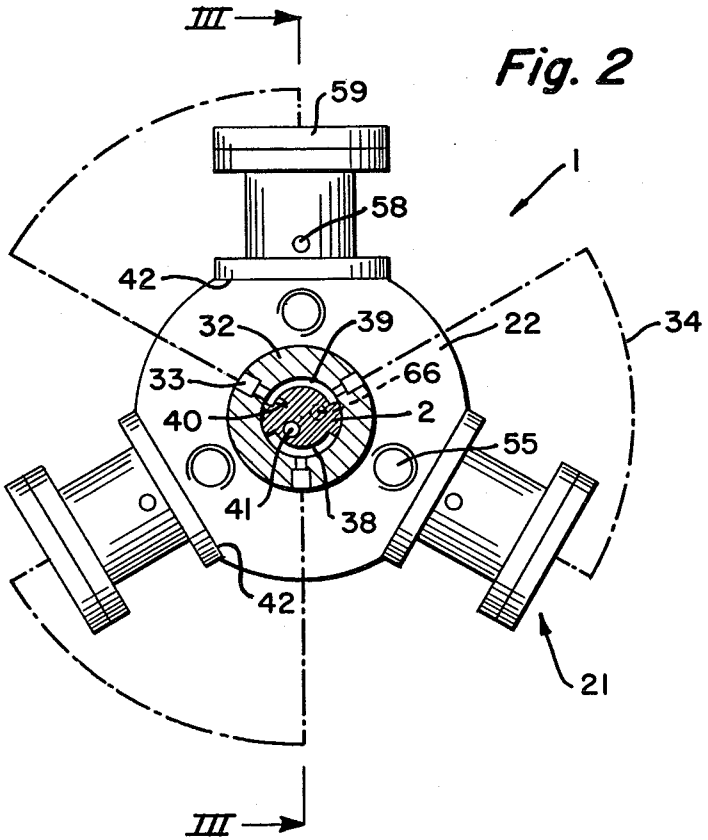
FIG. 2 is a view taken substantially along line II—II of FIG. 3 or FIG. 4 showing the details of the high-pressure mechanically live shaft and bore connection.
Figure 3:
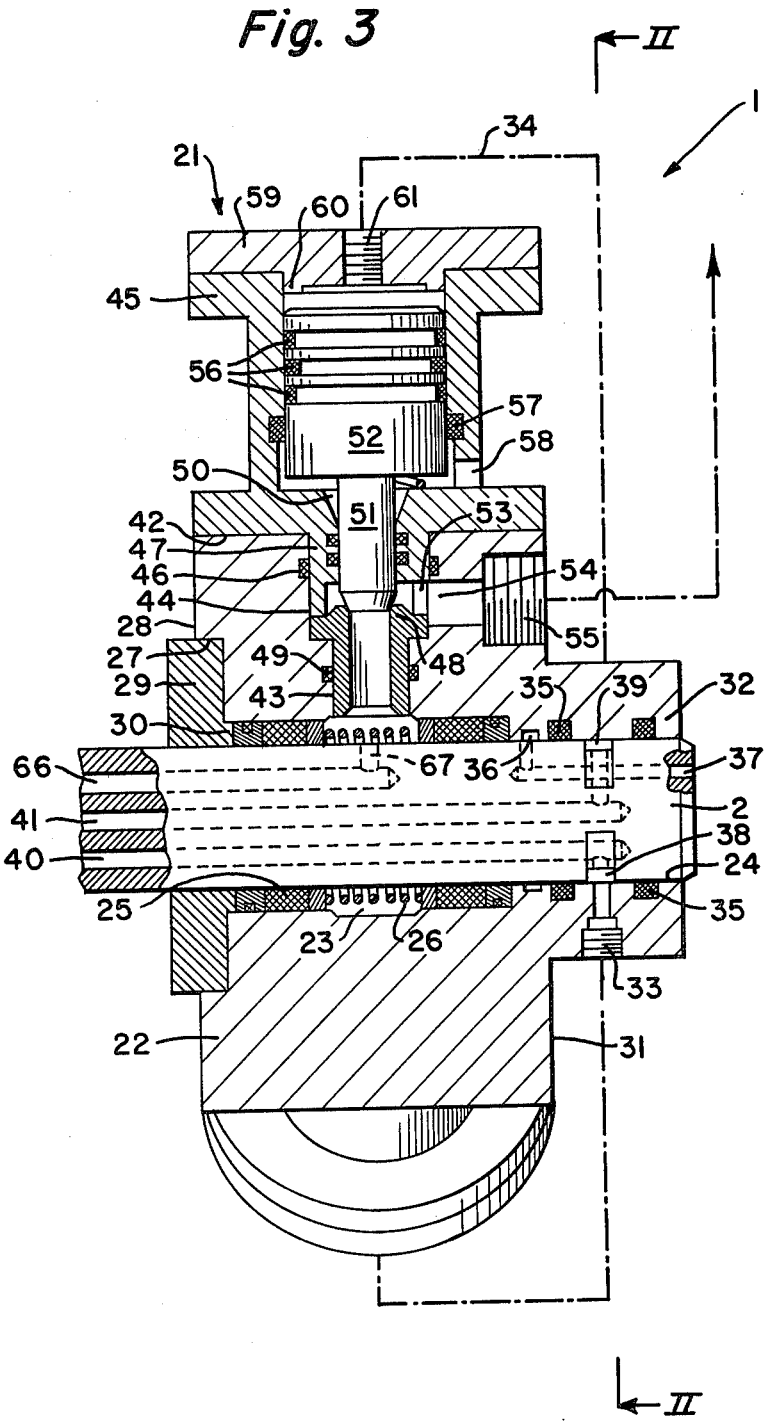
Fig. 3 is a cross-sectional view taken substantially along line III—III of FIG. 2 illustrating one embodiment of the invention.

This control facility is provided by means including three valves 21 shown in FIG. 2, for example, which are associated with the drive shaft and bore connection 1. As shown in FIG. 3, the connection 1 includes a casing 22 connected to the housing 3 so as to rotate therewith. Casing 22 has in a central widened portion 23 of its central bore 24 a two-element gland packing 25 which is biased axially by an intermediate compression spring 26. A cover 29 is mounted in a recess 27 in casing end wall 28 and has a cylindrical projection 30 extending into the central bore 24. The cover 29 closes the bore 24 and serves as an additional casing bearing. The opposite casing end wall 31 is provided with a cylindrical projection 32 having three radial bores 33 therein which are distributed over the periphery of the projection 30 as best shown in Fig. 2. The bores 33 carry hydraulic fluid to the valves 21 by way of conduits 34. Bores 33 are bounded by two ring seals 35 which are received in recesses in projection 32 and serve to seal the bores around the stationary shaft 2 in a liquid-tight manner. Disposed between the inner ring seal 35 and the end of the enlarged bore 23, within central bore 24, is an annular groove 36 through which leakage liquid can issue from the gland packing 25 through a discharge bore 37 in the shaft 2. Two diametrically-opposite arcuate recesses 38 and 39 (FIG. 2) are provided in the shaft periphery such that they communicate with the bores 33 and extend through an angle of approximately 150°. The recesses 38 and 39, in turn, communicate with bores 40 and 41 in stationary shaft 2 and are connected to a source of liquid under relatively low pressure, used as a control medium. The bores 40 and 41 receive liquid under pressures that are different.

As best shown in FIG. 2, the periphery of casing 22 is provided with three surfaces 42 offset with respect to each other by 120°, each surface 42 having a bore 43 (FIG. 3) which extends to the central, enlarged bore 24 of casing 22. A valve casing 45 is secured to the surfaces 42 and projects into a widened portion 44 of the bore 43. Fasteners such as screws, not shown, are utilized for fastening casing 45 to the casing 22 which rotates about the stationary shaft 2. A ring seal 46 extends around the projection 47 of the valve casing 45 and is received in a recess in bore 44. Projection 47 of the casing 45 bears on a shoulder of a bushing 48, this latter bushing being formed with a chamfer which serves as a valve seat. A ring seal 49 surrounds the bushing 48 as shown. A chamfered bore 50 is formed in the radially outer portion of projection 47 and receives a valve needle 51 of valve piston 52. The lower end of the valve needle extends into a cavity provided with a lateral opening 53 which communicates with a bore 54. Bore 54, in turn, communicates with an enlarged diameter portion 55 connected to a conduit 16 (FIG. 1) which conveys liquid under pressure to the drum nozzles 14. Valve needle 51 has a chamfer which seats on the chamfered upper opening of the bushing 48 to provide a valve seal. Valve piston 52, which is of larger diameter than the needle portion 51, is provided with a number of annular grooves which receive seals 56 as shown. When in communication with the lowest pressure bore, each valve piston 52 moves to a position to permit opening of a valve.

The piston 52 of enlarged diameter is also provided with a ring seal 57 disposed in a recess in the valve casing 45. At the lower end of the valve piston 52, and extending through the wall of casing 45, is a leakage bore 58. The cylinder which receives the piston 52 is covered or closed by a cover 59 having an annular projection 60 which extends into the cylinder. The end face of cover 59 is formed with a tapped bore 61 connected through a conduit 34 to one of the bores 33.

Figure 4:
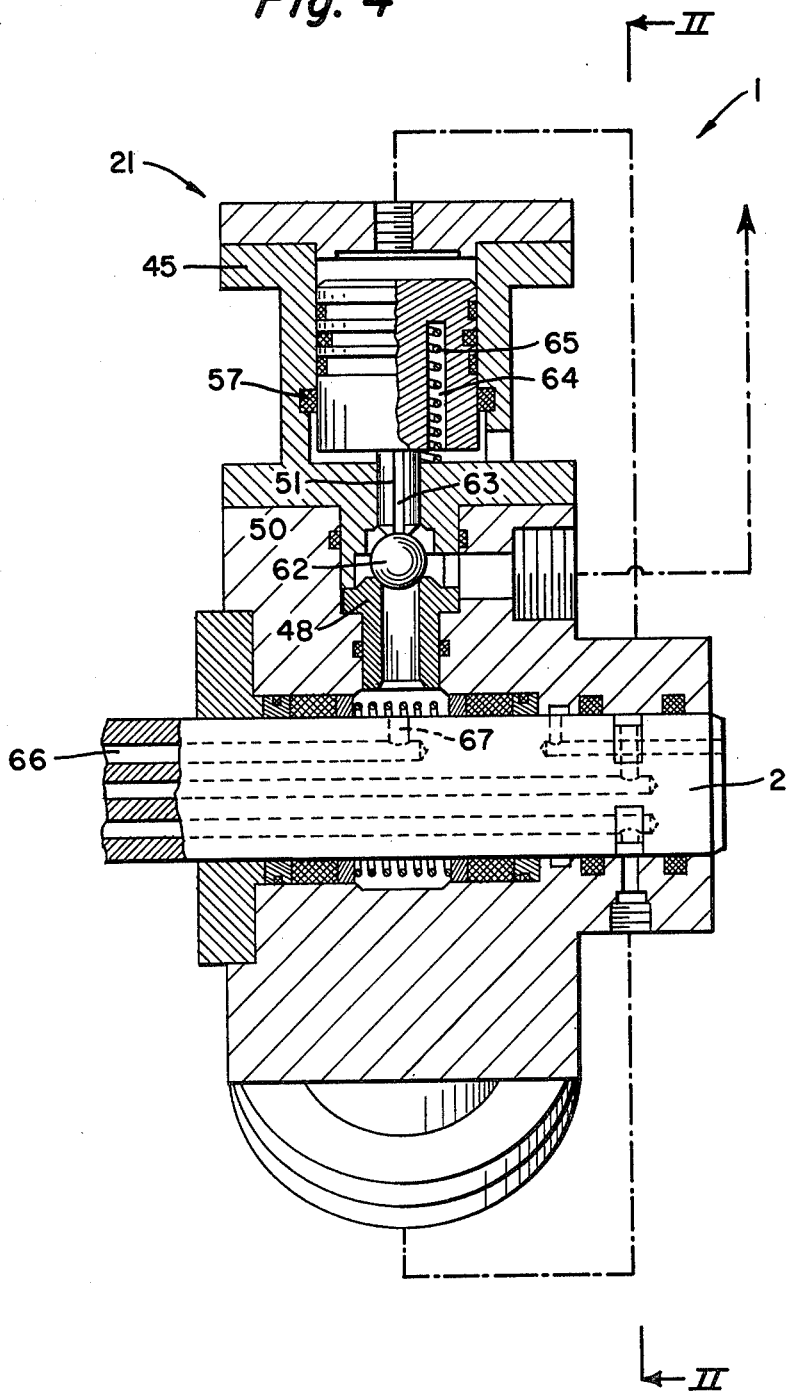
FIG. 4 is a cross-sectional view, similar to that of FIG. 3, illustrating another embodiment of the invention.

With specific reference to the embodiment shown in FIG. 4, a ball valve element 62 is disposed between valve needle 51 and bushing 48. As a consequence, there is no need for ring seals around the valve needle portion 51. The peripheral surface of the valve needle 51 is formed with a groove 63 which connects the underside of the enlarged diameter valve piston to the cavity within which the ball valve element 62 is disposed. By virtue of the groove 63, the liquid present between the ball valve element 62 and the needle 51 end face can discharge into the area beneath the enlarged diameter valve piston, the groove 63 thus providing a means of egress for the liquid from the valve casing. A helical spring 65 extends around the valve needle 51 and is disposed in an annular recess in piston 32. A similar spring, not shown, is provided for the piston 52 in the embodiment of FIG. 3. As will be appreciated, the spring 65 normally urges the piston 52 upwardly as viewed in FIGS. 3 and 4 to open the valve, meaning that the valve will be closed only when pressure is exerted on the upper surface of the piston 52 via conduit 34.

In both embodiments of the invention, the periodic delivery of high-pressure liquid to the nozzles 14 is controlled by means of the valves 21. The drum shaft 2 has an axial bore 66 connected to a source of liquid under high pressure, this latter bore extending into a radial cross bore 67 which terminates near the compression spring 26. At the same time, liquid under lower pressure is present in the bores 40 and 41 and supplied to the recesses 38 and 39.

It will be appreciated that as the drum and valves rotate around the stationary shaft 2, liquid under high pressure is always present in the widened portion 23 of central bore 24, this high-pressure liquid acting to urge the valves 21 into open positions. However, by virtue of the fact that the recesses 38 and 39 will not always be in communication with respective ones of the bores 33 and conduits 34 leading to the valves 21, at least one of the valves will be permitted to open under the force of spring 65 while the others are closed due to the fact that the upper ends of their pistons 52 are exposed to low-pressure control fluid. By proper positioning of the recesses 38 and 39, therefore, successive ones of the valves 21 will open as the drum rotates to supply liquid under pressure to the nozzles 14 ony when those nozzles are adjacent the face area being mined.

Since the plow 18 is pivoted around the drum 5 when the direction of movement of the mining machine is reversed, the shaft 2 can be turned and resecured by means of fastening means, not shown, such that only those nozzles on the opposite side of the drum, which will now face the material being mined, will receive the high-pressure liquid.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a drum cutter for a longwall mining machine of the type having on its periphery nozzles for discharging high-pressure liquid onto a face area; the improvement of means for controlling the discharge of liquid from said nozzles such that liquid is discharged only from nozzles on an arcuate segment of said periphery when facing said face area, said controlling means comprising a shaft on which said drum cutter rotates, a plurality of valves circumferentially spaced around said drum cutter and rotatable therewith, each of said valves being adapted to supply high-pressure liquid to an associated group of nozzles which occupy a restricted arcuate segment of the periphery of the drum cutter, each of said valves including a small diameter end subJected to high-pressure liquid which is to be forced through said nozzles and a large diameter end subjected to lower pressure liquid used to control actuation of the valves, and means for conveying the high and low pressure liquids to the small and large diameter ends, respectively, of each valve.

2. The improvement of claim 1 wherein the shaft on which said drum cutter rotates is non-rotatable.

3. The improvemant of claim 1 wherein said valves are carried on a casing which rotates around said stationary shaft and wherein the means for conveying the low-pressure liquid to the large diameter ends of each valve includes arcuate recesses in said stationary shaft, and radial bores in said casing adapted to successively communicate with the arcuate recesses as the casing rotates.

4. The improvement of claim 3 wherein the means for conveying high-pressure liquid to the small diameter end of each valve comprises an annular bore surrounding said shaft, a passageway in said shaft for conducting high-pressure liquid to said annular bore, and radial passageways connecting said annular bore to the small diameter end of each valve.

5. The improvement of claim 3 wherein said recesses in the stationary shaft are diametrically opposite and extend over a sector angle of approximately 150°.

6. The improvement of claim 5 wherein said stationary shaft can be rotated and locked in one of a plurality of selected positions about its longitudinal axis.

* * * * *